United States Patent [19]

Gray, Jr. et al.

[11] Patent Number: 4,961,090

[45] Date of Patent: Oct. 2, 1990

[54] LARGE MEDIA PROPORTIONAL COPYING SYSTEM

[75] Inventors: Gerald A. Gray, Jr., Webster; John L. Webb, Fairport, both of N.Y.

[73] Assignee: Xerox Corporation, Stamford, Conn.

[21] Appl. No.: 389,138

[22] Filed: Aug. 3, 1989

[51] Int. Cl.[5] ..... G03G 13/00; G03G 21/00

[52] U.S. Cl. ..... 355/50; 355/55; 355/77; 355/243; 355/309

[58] Field of Search ..... 355/48–51, 355/55, 77, 233, 243, 309, 311; 101/DIG. 37

[56] References Cited

U.S. PATENT DOCUMENTS

| | | | |
|---|---|---|---|
| 3,239,220 | 3/1966 | Lot et al. | 271/75 |
| 3,689,143 | 9/1972 | Case et al. | 355/311 X |
| 3,861,797 | 1/1975 | Nishida et al. | 355/52 |
| 3,888,579 | 6/1975 | Rodek et al. | 355/14 |
| 4,000,943 | 1/1977 | Bar-on | 355/8 |
| 4,008,956 | 2/1977 | Stemmle | 355/8 |
| 4,110,028 | 8/1978 | Schneider | 355/309 X |
| 4,144,550 | 3/1979 | Donohue et al. | 364/107 |
| 4,283,773 | 8/1981 | Daughton et al. | 364/900 |
| 4,408,870 | 10/1983 | Nishikawa et al. | 355/309 X |
| 4,420,249 | 12/1983 | Trump | 355/84 |
| 4,455,018 | 6/1984 | Colglazier et al. | 271/227 |
| 4,536,084 | 8/1985 | Tokuhara | 355/55 |
| 4,571,061 | 2/1986 | Osanai et al. | 355/8 |
| 4,579,444 | 4/1986 | Pinckney et al. | 355/14 |
| 4,634,263 | 1/1987 | Miwa | 355/309 |
| 4,650,317 | 3/1987 | Oushiden et al. | 355/57 |
| 4,719,492 | 1/1988 | Hyodo | 355/52 |
| 4,785,325 | 11/1988 | Kramer et al. | 355/50 X |
| 4,799,084 | 1/1989 | Koike et al. | 355/14 |
| 4,831,420 | 5/1989 | Walsh et al. | 355/203 |

OTHER PUBLICATIONS

Pending Xerox Appln., Atty. Docket No. D/87356, filed 12-16-88, U.S. Ser. No. 285,172.

*Primary Examiner*—R. L. Moses

[57] ABSTRACT

A copying system with a large document feeder for making large copy sheet (or web) media copies by moving the document past an optical scanning slit at a preset speed proportional to the speed of the imaging surface, and transferring the image onto a selected large copy media, with an easily correctable image size. The disclosed system provides for accurately controlling and adjusting the size of the copy image relative to the document image, by controlled adjustment of the magnification or reduction without requiring anamorphic or other lens changes. It is accomplished by making a test copy of the document onto the selected large copy media in the copier; measuring the dimensional change in the image on that copy media relative to the document image, in the direction of movement; deriving a simple numerical correction factor corresponding to the measured dimensional change; entering the correction factor into a variable speed control for the large document feeder to reset the speed of movement of the document past the optical scanning slit by an amount proportional to the correction factor, to provide a corresponding image reduction or magnification dimensional change of the copy image; and making subsequent copies on that media with the document moving past the optical scanning slit at the reset speed. The correction factor derivation comprises a simple calculation also including the approximate overall length in the movement direction of the test copy media or the document, and may be derived with a simple numerical table. The system can provide an exact size copy image of the document image by compensating for varying dimensional changes of different copy media in the fuser, etc., or a selectable image size change. Different selectable preset nominal (initial, but resettable) correction factors for various copy media are desirably provided.

15 Claims, 3 Drawing Sheets

LARGE MEDIA PROPORTIONAL COPYING SYSTEM

Cross-reference is made to copending applications by the same assignee, filed Dec. 16, 1988, and Jun. 1, 1989, as U.S. application Ser. Nos. 07/285,172, and 07/359,611 and 07/360,176, respectively. If any claim may be made for the benefit of the priority or filing dates thereof, it is hereby made. Cross-reference is also made to another copending application of even date by the same assignee, U.S. Ser. No. 07/389094, filed Aug. 3, 1989.

This invention relates generally to large sheet copying machines, and more particularly to an improved, simple low cost and more accurate large document and copy handling and feeding system for a large sheet or web copying system as, for example, an engineering or architectural drawing copier or the like, in which fine adjustments may be made to the image size ratio between the document and the copy, including compensation for various copy media shrinkages or expansions in copying.

With the system disclosed herein, varying copy media shrinkages or expansions, of various media, can be compensated for or corrected automatically or semi-automatically with measurement in the copier processing movement direction of that dimension of the outputted copy sheet or its image vs the document sheet being copied.

The present system is particularly adapted for large sheet copiers in which the document image is formed on an imaging surface by slit scan exposure of the document while the document is moved past an optical scanning slit. With the system disclosed herein, copy paper shrinkage in the fuser of the copier can be compensated for in the processing direction by changing the document scanning velocity relative to the velocity of the imaging surface by a controlled amount.

The system disclosed herein is also useful with a system of said above-cited U.S. application Ser. No. 07/285,172 for deliberate image reduction or magnification using a dual pass image reduction or magnification, on one axis at a time, with an anamorphic copy formed from the original document in the first pass used as an intermediate document rotated and fed at 90 degrees in the second pass relative to the first pass for anamorphic reduction of the image on the other axis, for proper uniform image reduction or magnification on the second pass copy.

By way of background of particular interest, U.S. Pat. No. 4,799,084 issued Jan. 17, 1989 to M. Koike, et al, (Canon) discloses a regular size sheet copier wherein it is noted that control means can delay or advance registration means on the basis of a change in the dimension of the sheet material (being duplexed or receiving a superimposed second image) in the conveying direction resulting from the initial image forming operation in the copier (image fusing). E.g., Claim 18 and Col. 6, starting at line 41, Col. 9 line 18 et al, etc. (Other descriptions therein relate to lateral sheet shifting therefore).

Also of interest is U.S. Pat. No. 4,719,492 issued Jan. 12, 1988 to H. Hyodo (Minolta) teaching variable speed ratio scanning electrostatic photocopying and providing anamorphic enlarging or reducing. Likewise, for other photosensitive members, Nishida et al U.S. Pat. No. 3,861,797 and Trump U.S. Pat. No. 4,420,249. Also noted were Tokuhara U.S. Pat. No. 4,536,084; Osanai et al U.S. Pat. No. 4,571,061; and Oushiden et al U.S. Pat. No. 4,650,317.

Of particular interest in regard to a customer card overlay and scale system, for setting document feeder registration with an overlaid copy of a special original, is Xerox Corp. U.S. Pat. No. 4,831,420 issued May 16, 1989 (D/87077).

Various types of engineering drawing or other large sheet or web copiers are known in the art. An early xerographic engineering drawing copier with large document feeding is shown in Xerox Corp. U.S. Pat. No. 3,239,220. The following patent disclosures are noted by way of background examples of Xerox Corporation large document and large copy sheet copiers, including those with document feeders: U.S. Pat. Nos. 4,771,310; 4,823,663; 4,784,345; 4,714,978; 4,138,102; 4,688,926; 4,690,540; 4,653,894; 4,666,293; 4,689,471; 4,680,040; 4,693,588; 4,639,122; 4,766,456; 4,822,978; 4,821,974.

Some examples of U.S. patents on servo-motor or stepper-motor driven original document feeders for copiers, in general, are U.S. Pat. Nos. 3,888,579; 4,000,943; 4,008,956; 4,144,550; 4,283,773; 4,455,018; and 4,579,444.

The "document" here is the sheet (original or previous copy) being copied in the copier onto the "copy sheet", or "copy". In the terminology herein the term "document" or "document sheet" refers to a conventional sheet of paper, plastic, or other such conventional individual physical image media or substrate, which is usually flimsy, relatively difficult to manipulate, and easily damaged.

Various sheet feeders are used with automated drive rolls and the like in various printers and/or copiers, but these feeders are often inappropriate for use in feeding large sheets, especially for low cost, slow speed, coping machines. It is necessary to feed copy sheets in some of these machines measuring, for example, 61×91 cm. (24×36 inches) or 91×122 cm. (36×48 inches), or even uncut webs of much greater length. Furthermore, loading of large documents and/or copy sheets presents operator handling difficulties and is time consuming. Typically, loading and unloading of the large sheets involves critical manual handling steps.

Mishandling or misfeeding of large document or copy sheets in (and to and from) a copier can cause wrinkling, buckling, tearing, or other sheet damage. It can also cause miscopying, such as skewed, uneven, unevenly magnified, or misregistered images. Thus, the loading, starting positions, speed (sheet velocity) and direction of movement of the large documents and/or copy sheets can be quite critical to commercially acceptable copying.

The large size of the copy sheet or web media in such copying machines presents special difficulties in matching or adjusting the document image size to the size of the corresponding image on the copy. In particular, such large copy media sizes are generally substantially affected by humidity and/or heat changes. Thus, in particular, the thermal fusing process used in conventional copiers for fixing the image can substantially change the copy sheet dimensions, and therefore dimensions of the image thereon. This dimensional change can be 1% or more, which in large sheets can be a size and magnification error of several centimeters. In long web media the error continues to accumulate. Part of the image can even be completely lost from the copy, if the document image "overfills" a copy sheet which has shrunk to a dimension smaller than an image dimension. Since copy media is generally fed through a copier in a processing direction of its longest dimension, the dimensional change effect is the most pronounced in that dimension. Furthermore, the dimensional change varies greatly depending on the media. For example, paper copy media is much more greatly dimensionally affected by humidity than plastic. Different papers, vellum or parchments are affected differently. Some media can even shrink under conditions in which others will expand, and vice versa.

In the embodiment disclosed herein, a particular disclosed feature relates to the controlled interrelationship of large document and copy sheet feeding in a large document copier. In such copiers typically the large documents are loaded into and fed by constant velocity transport document handler or CVT. Typically, a CVT has document feeding roller nips on opposite sides of an illuminated imaging slit. Typically, the CVT moves the document past an illuminated imaging slit for scanning copying while the document is moving at a speed corresponding to the surface speed of the imaging surface. The imaging surface may be a photoreceptor, as described here, on which an image is developed and transferred to a copy sheet or web. Alternatively, the imaging surface may be a special light sensitized copy sheet media. In the disclosed embodiment of the subject system and apparatus, the documents are moved by the CVT in a finely compensated speed system to be described herein.

A specific feature of the embodiment disclosed herein is to provide a copying system for making large copies of large documents on a large document copier, in which a document is moved past an optical scanning slit by a large document feeder in a copying pass, to form, via a lens system, an image of the document on a copier imaging surface by slit scan exposure of the document while the document is moved past the optical scanning slit at a preset speed proportional to the speed of said imaging surface, and wherein the image of the document on the imaging surface is transfer-copied onto a selected large sheet or web copy media to form a copy image thereon; the improvement in controlling and adjusting the size of the copy image relative to the document image, including compensation for copy media dimensional changes due to said copying, by controlled adjustment of the magnification or reduction of the document image, without anamorphic or other lens changes, comprising the steps of: making a test copy of the document onto the selected large copy media in said large document copier; measuring the dimensional change in the copy image on said selected large copy media, relative to said document image, in the direction of movement; deriving a correction factor corresponding to said measured dimensional change; entering said correction factor into a variable speed control for said large document feeder to reset the speed of said movement of the document past said optical scanning slit by an amount proportional to said correction factor, to provide a corresponding image reduction or magnification dimensional change of the copy image on the copy media in the direction of movement; and making a subsequent copy on said large copy media with said document moving past said optical scanning slit at said reset speed.

Further specific features provided by the system disclosed herein, individually or in combination, include those wherein said deriving of a correction factor corresponding to said measured dimensional change comprises a simple calculation including the approximate overall length in the movement direction of the test copy media or the document; wherein said correction factor is a simple number; wherein said large document is retained throughout all said steps in said large document feeder without substantial slippage or skew; wherein said document is further retained in said large document feeder until a selected further number of copies is made on the same type of large copy sheet or web media as the test copy, at the same said reset speed, before releasing that document from said large document feeder; wherein the image of the document on the imaging surface which is copied onto a selected large copy sheet or web media is thermally fused onto said copy media in a heated fuser which changes the dimensions of said copy media and wherein said system is operated to make a substantially exact size copy image of the document image which compensates for said dimensional changes of the copy media in said fuser; wherein said correction factor is a number programmably stored in nonvolatile memory in said copier and used for making subsequent copies on the same type copy media with the same correction factor, and wherein plural said correction factors, for different respective copy media, are stored in said copier and used for making subsequent copies on the same type of copy media with the same correction factor, and wherein, prior to copying, a selection is made in accordance with the type of copy media of one of said plural said correction factors for that type of copy media, and said one selected nominal correction factor is used for making said test copy by setting the speed of said movement of the document past said optical scanning slit to a speed proportional to said selected nominal correction factor, and wherein subsequent copies on the same type copy media are made with the same said selected nominal correction factor until a new correction factor is entered, corresponding to said measured dimensional change; and/or wherein an orthogonally uniform image reduction or magnification copy is made with the subject system by using a dual copying pass image reduction or magnification, on one axis at a time, in which an anamorphic reduction or magnification copy is first made from the original document in a first copying pass on one axis, and then said anamorphic copy is used as an intermediate document for a second copying pass, but for said second copying pass said anamorphic copy is initially rotated 90 degrees and then moved past said optical scanning slit oriented at 90 degrees in this second pass relative to said first pass, to provide anamorphic reduction of the image on that other axis, for proper, uniform, orthogonal, image reduction or magnification on the second pass copy.

Further disclosed features include, in a large document copier, having a large document sheet feeder with document drive means for moving a large document at a preset sheet feeding velocity past a scanning slit in said copier, for copying the large document image onto a large copy sheet or web fed into said copier by a large copy sheet or web feeder, the improvement in controlling and adjusting the size of the copy image relative to the document image, including compensation for copy media dimensional changes due to said copying, by controlled adjustment of the magnification or reduction of the document image, without anamorphic or other lens changes, comprising; electronically controllable variable speed document drive means for driving said large document sheet feeder and a document therein at a selectable variable speed; control means for controlling the speed of said document drive means in response to an entered correction factor determined from the dimensional change in the copy image on a test copy of said selected large copy media relative to said document image in the direction of movement to reset the speed of said movement of the document past said optical scanning slit by an amount proportional to said correction factor, to provide a corresponding image reduction or magnification dimensional change of the copy image on the copy media in the direction of movement; said copier being adapted to make a subsequent copy on said large copy media with said document moving past said optical scanning slit at said reset document movement speed by storing said correction factor in said control means, and wherein plural different nominal correction factors, for different types of copy media, are selectively stored in said copier control means, and wherein a selection is provided of one of said plural said correction factors for the selected type of copy media, and said one selected nominal correction factor is used for making said test copy by setting the speed of said movement of the document past said optical scanning slit to a speed proportional to said selected nominal correction factor, and wherein subsequent copies on the same type of copy media are made with the same said selected nominal correction factor until a new correction factor is entered into said control means, and wherein said large document sheet feeder and said control means are adapted to retain a large document in said large document sheet feeder without substantial document slippage or skew until a selected number of copies is made from a document at said reset sheet feeding velocity before releasing that document from said large document feeder.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus, the present invention will be better understood from this description of this embodiment thereof, including the drawing figures (approximately to scale) wherein:

Figure 3:
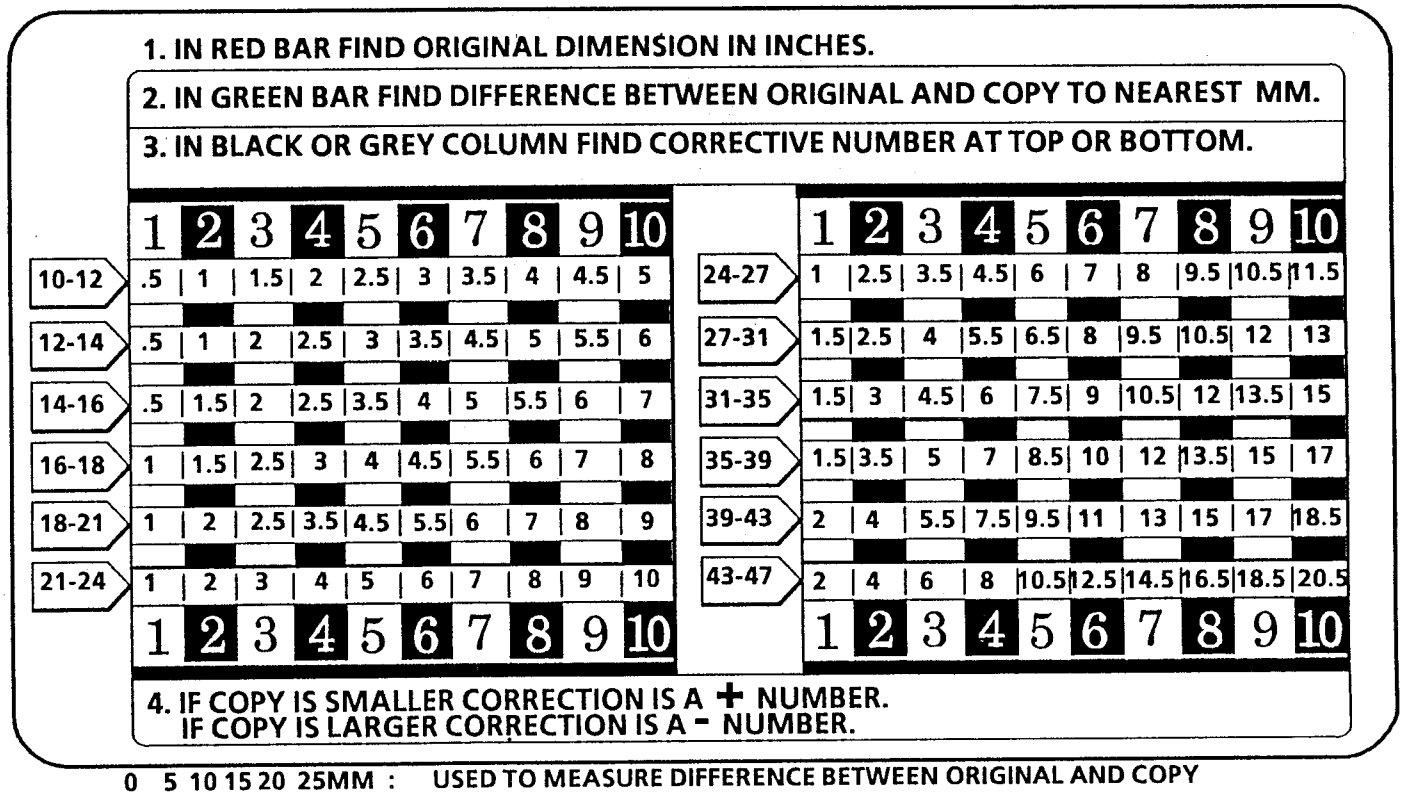

and FIG. 3 is a representation of an exemplary integral operator scale adjust card with a scale for measuring differences between the document and the copy, and a table for determining and readily programming the copier controller with a corresponding error correction number.

In the present system, use is made of the fact that if the CVT document transport speed is a presettable and maintainable at a known and truly constant velocity, and if there is no slippage in moving the document past its imaging position at that velocity, then if the CVT can be set to a norm or nominal velocity at which CVT is driven at exactly the same speed as the imaging surface for the copy, then the image transferred to the copy will be exactly the same size as the image on the document, and any difference or change in the size of the final image on the final copy will correspond exactly to the difference or change in size of the image portion of the final copy sheet itself. Thus, if the copy sheet has shrunk after image transfer by 1%, for example, so has the image thereon.

Furthermore, if the actual image shrinkage or expansion dimension is divided by the initial total length of the image, (or even by the total length of the sheet, if the image fills most of the sheet), then the ratio or percentage of shrinkage can be calculated. That percentage can then be used to change the document transport speed by an equal amount to fully compensate for the sheet shrinkage distance. For example, a 1% shrinkage can be compensated for by slowing the CVT by 1%, which increases the length of image on the initial imaging surface by 1% prior to the media shrinkage, thereby correcting for it. This utilizes the system herein whereby the documents are moved by the CVT in a finely compensatable variable speed system, utilizing an electronically programmable controlled stepper motor or servo motor drive of the CVT document transport.

Figure 1:
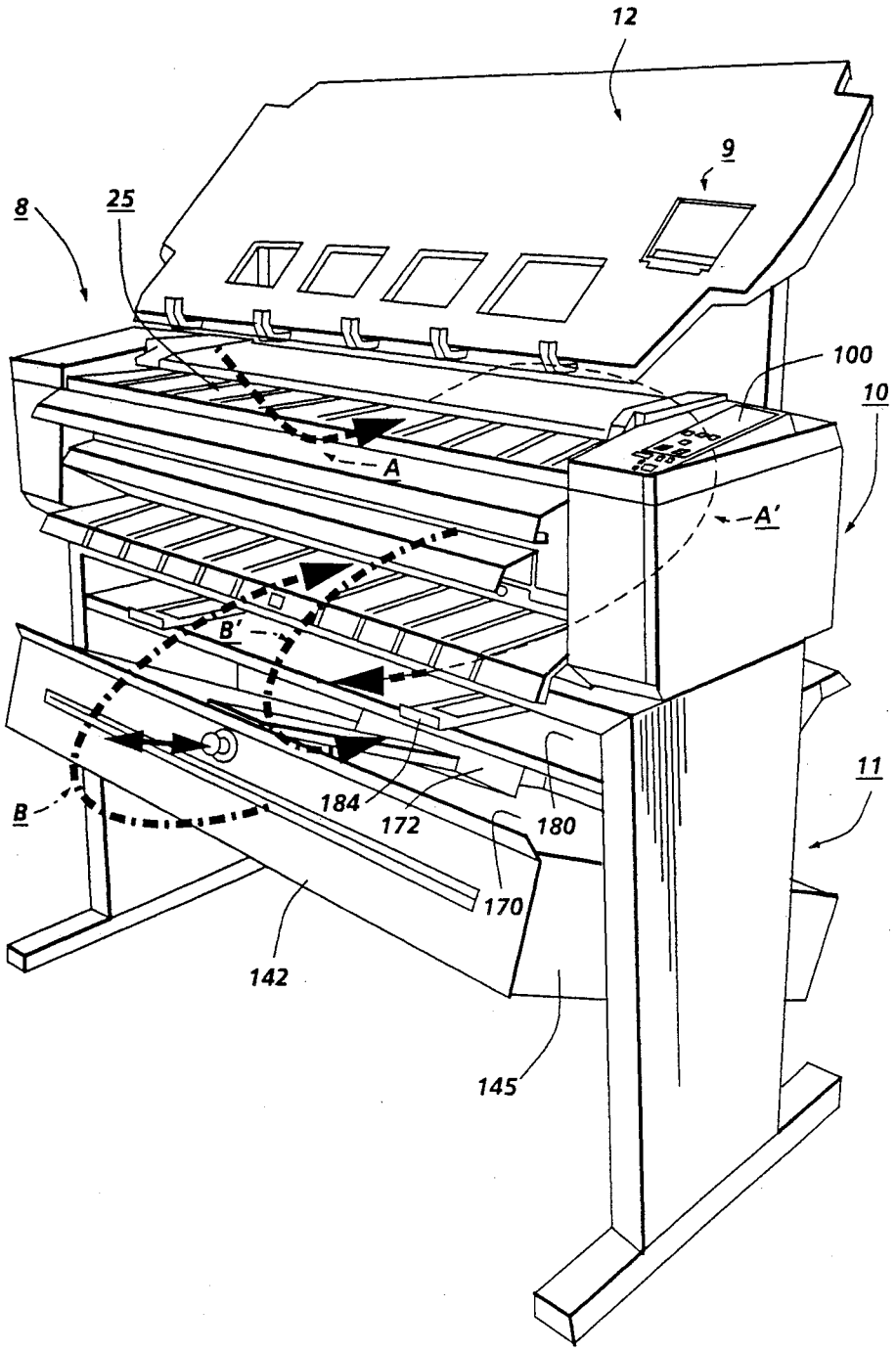
FIG. 1 is a frontal perspective view of one embodiment of a copying machine incorporating the features of the present invention; with simplified exemplary dashed line document feeding paths, and dot-dashed line copy sheet feeding paths, all with movement arrows.
Figure 2:
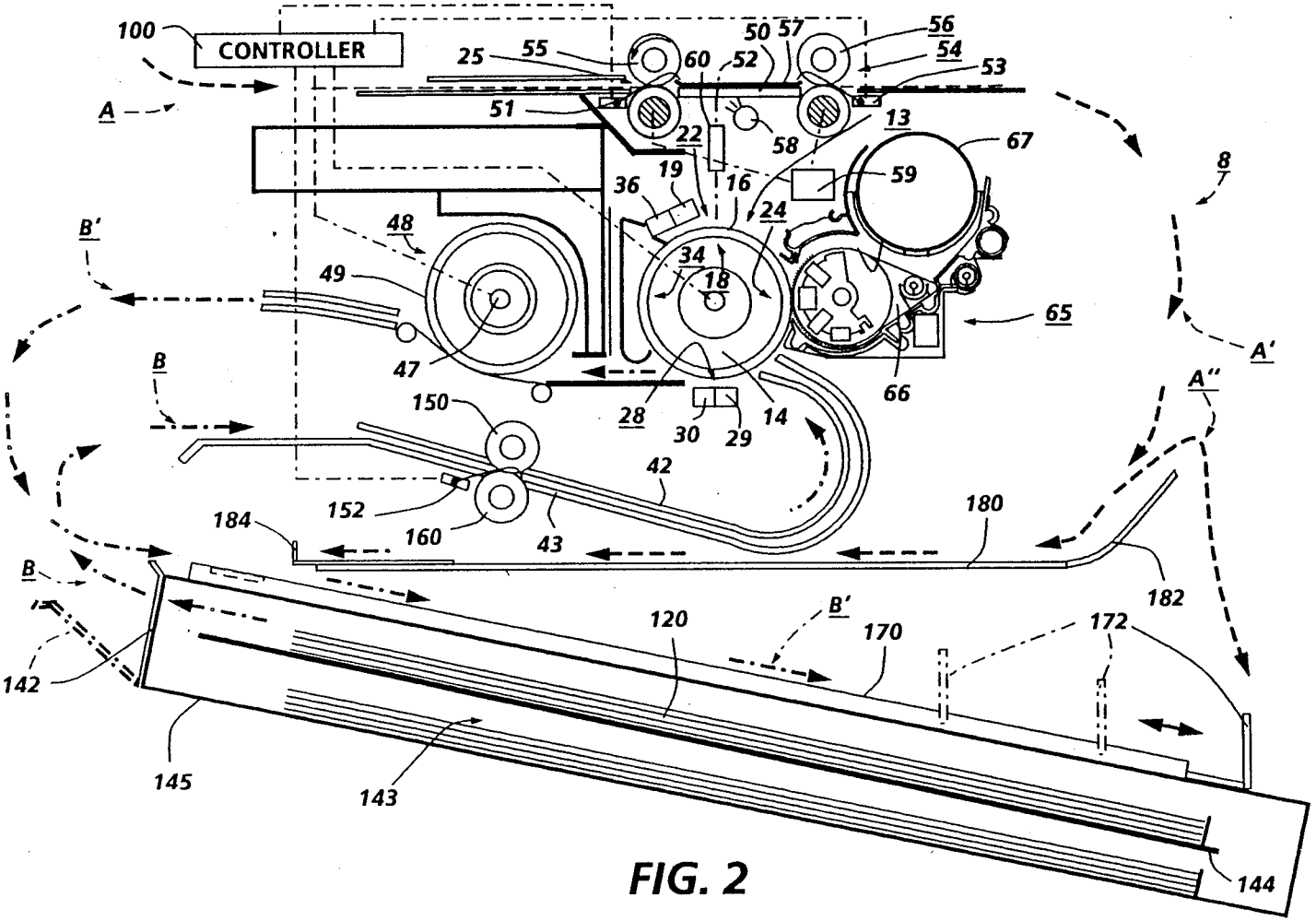
FIG. 2 is a schematic cross-sectional side view of the exemplary machine of FIG. 1.

Describing now in further detail the exemplary embodiment with reference to the Figures, there is shown an automatic xerographic reproduction or printing machine 8 for copying large documents, fed by constant velocity type document transport or feeder (CVT) 54. Machine 8 has a suitable frame or housing 10 within which its machine xerographic section 13 is operatively supported. The exemplary copier 8 may be, for example, a well known Xerox Corporation large document copier, or any other xerographic or other copier, as illustrated and described in various patents cited above, and otherwise. As shown in FIG. 1, the processor or xerographic section 13 thereof is supported by a stand 11 here. A document organizer 12 is attached to the frame 11, providing a document tray above the document sheet input 25 (see path A), and sloping down towards the front of the machine 8. The document organizer 12 may include a flip-card type of operator instruction manual 9. Also it is apertured as shown to provide a view therethrough of documents being fed rearwardly by the CVT 54. It also has front stop or catch fingers as illustrated.

The control of all copier and document handler and finisher operations is by a machine controller 100. The controller 100 preferably and conventionally comprises a known type of programmable microprocessor system, as exemplified by extensive prior art, e.g., U.S. Pat. No. 4,475,156 and its references. The particular desired functions and timings thereof are provided by conventional software programming of the controller 100 in nonvolatile memory. The controller 100 controls all of the machine steps and functions described herein, including all sheet feeding. This includes the operations of the document feeder and its drives, document and copy sheet gates, copy sheet feeder drives, any finishers, etc. As further taught in those references, the controller 100 also conventionally provides for storage and comparison of the counts of the copy and document sheets, the number of documents fed and recirculated, the desired number of copy sets, and other selections by the operator through a connecting panel of control switches. Controller information is utilized to control and keep track of the position of the document, the copy sheets, and the operative components of the apparatus by their electronic connections to the controller. For example, the controller may be conventionally connected to receive and act upon jam, timing, positional, and other control signals conventionally received from various document sheet sensors in the document path. The controller automatically actuates and regulates the positions of sheet path drives and gates depending upon which mode of operation is selected, and the status of copying in that mode. The controller 100 also conventionally operates and changes displays on a connecting instructional display panel, which preferably includes said operator function selection buttons or switches.

Briefly, and as will already be familiar to those skilled in the art, the machine xerographic section 13 includes an image recording member, here a rotatable photoreceptor 14 comprising a drum having a photoconductive imaging surface 16. Operatively disposed about the path of imaging surface 16 is a charge station 18 with charge corotron 19 for placing a uniform charge on the photoconductive surface 16, an exposure station 22 where the previously charged photoconductive surface 16 is exposed to light image rays from the document 9 being copied or reproduced, a development station 24 where the latent electrostatic image created on photoconductive surface 16 is developed by toner, a transfer station 28 with transfer and detack corotrons 29, 30 for transferring the developed image to a suitable copy substrate media or material such as a copy sheet 120 fed forward thereto in timed relation with the developed image on photoconductive surface 16, and a cleaning station 34 that may include a cleaning blade and a discharge corotron 36 for neutralizing residual charges and removing leftover developer from surface 16.

Copy sheets 120 are brought forward to transfer station 28 by mating idler roll 160 and registration and drive roll 150, with sheet guides 42, 43 serving to guide the sheet through an approximately 180° turn prior to transfer station 28. Following transfer, the sheet 28 is carried forward to a fusing section 48 where the toner image is fixed by fusing roll 49. Fusing roll 49 is heated by a suitable heater such as lamp 47 disposed within the interior of roll 49. In this exemplary fuser 48, the copy sheet is held by an opposing belt against the controlled temperature heated surface of roll 49. After fixing, the copy sheet is discharged.

The illustrated CVT document handling system 54 provides for automatically transporting individual document sheets onto and over the conventional platen imaging station 50 of the copier 8 at an accurately predetermined steady velocity. Documents are inputted to the front or upstream end thereof via an input path 25. A narrow but full width transparent glass platen 50 preferably supports or confines the lower surface of the document as the document is moved past a scanning line 52 by the CVT 54, under a closely spaced white backing plate or foot 57 which confines the upper surface of the document there. As will be understood, scanning line 52 extends across the width of platen 50 at a desired position where the document is to be optically scanned line by line as the document is uniformly moved at a constant copying speed over platen 50 by document transport 54. CVT transport 54 has input and output document feed roll pairs 55, 56, respectively, on each side of scanning line 52 for moving a document 9 across platen 50 at the predetermined copying velocity or speed. An exposure lamp 58 is provided to illuminate a strip-like area of platen 50 at scanning line 52. The image rays from the document line being scanned are transmitted by a gradient index fiber lens array 60 to exposure station 22 to expose the photoconductive surface 16 of the moving photoreceptor 14. For 1 to 1 copying (that is, equal size or 100% reduction/magnification copying), the velocity of the document at scanning line 52 is set equal to the velocity of surface 16 of the photoreceptor 14. The photoreceptor 14 is conventionally driven at a constant speed by a conventional synchronous motor drive.

These document feed roll pairs 55, 56 here are non-conventional, and are non-conventional driven. Here, the CVT 54 drive is by a controller programmed controlled stepper motor drive 59 of the driving rollers, which are the lower rollers of the illustrated roller pair 55, 56 nips. These lower driving rollers are preferably a spaced plurality of accurately OD ground rubber rollers integrally mounted along a very rigid large diameter steel center shaft which is accurately rotatably mounted to the machine frame by ball bearings and rotatably driven by the stepper motor drive 59. This provides accurately planar, non-skewing, and non-wrinkling feeding nips for the document. The opposing, mating, idler rollers thereabove are resiliently deformably spring mounted to be deflectable upwardly by document passage through the nips, and preferably have some freedom of axial tilt as well, so as not to induce any skew on the document. As will be described further herein, here this stepper motor drive 59 of the CVT 54 is reversible, with a higher reverse direction document driving speed. Conventional static eliminator brushes may be provided at the CVT 54 output, which is towards the rear of the machine.

Developing station 24 conventionally includes a developer housing 65, the lower part of which forms a sump 66, fed from a dispenser 67 of developer comprising a mixture of larger carrier particles and smaller toner or ink particles. A rotatable magnetic brush developer roll 68 is disposed in developer housing 65 in operative relation to the photoconductive surface 16. Developer roll 68 brings toner from sump 66 into developing relationship with photoreceptor 14 to conventionally develop the latent electrostatic images formed on the photoconductive surface 16 from the document image exposure.

The copy sheet handling system 100 here includes a humidity control storage chamber with an internal electrical heater for the large copy sheets 120. This comprises a copy sheet chamber 145, in which the copy sheets 120 to be fed are supported in stack-like fashion on a tray base 144. Extra sheets may be stored thereunder in tray base 143 for later use by placement onto base 144 for feeding. Heating of the chamber maintains dryness of the sheets as well as preventing curl from setting up in the sheets.

Replenishment of copy sheets into copy sheet tray 145 is quick and easy for a number of reasons. First, the trays are tilted about 20 degrees with respect to a horizontal plane. This allows copy sheets to settle against the back of the copy sheet trays due to gravity while simultaneously inhibiting multifeeding. In loading a fresh supply of copy sheets into the chamber, cover 142 is opened and a stack of copy sheets are placed onto base 144 and cover 142 is closed. The positioning angle of the tray 144 enhances the feeding of single copy sheets therefrom since gravity is being used to inhibit multifeeding.

It will be appreciated that alternatively or optionally the copy sheet supply may be from a web roll. This may include a chopper cutter automatically cutting off a desired fed length of copy sheet to match the document sheet length, which can be measured automatically from the input feeding time of the document by the CVT 54 between actuation and deactuation of switch 51, for example. That is, the transit time from the initial document trail edge actuation of switch 51 and the start of feeding (or the lead edge actuation of switch 53 as feeding starts) until the release of switch 51 as the trail edge of the document passes it. See U.S. Pat. No. 4,823,663 for an example of a web roll feeder.

For feeding a copy sheet 120 into the copy processor for copying, as described in the above-referenced copending applications, a simple feeding assist device may be provided to help the operator hand manipulate the topmost copy sheet on tray 144 out the front door 142 of chamber 145. The removed copy sheet is then hand manipulated via copy input path B into the nip of the stalled copy sheet input and registration roll pairs 150, 160, tripping switch 152 there. Registration roll pair 150, 160 then are driven to advance the copy sheet along a paper guide path to transfer station 28, registering the copy sheet with the image on the photoconductive surface 16 of photoreceptor 15, by bringing the copy sheet into transfer relation with the developed image on photoconductive surface 16 at transfer station 28. There, suitable transfer and detack means, such as transfer and detack corotons 29, 30, transfer the toner image to the copy sheet and then separate the copy sheet for fixing the image in downstream fuser 48 and discharge as a finished copy sheet along copy output path B'. Copy output path B' here preferably includes a copy output stacking tray 170 (with a slide adjustable backstop 172 adjustable to the size of the copy media), into which the copy sheet may be directed as it is outputted.

In operation, a document to be copied is first inserted by the operator into the front of the machine 8, via document input 25 in the path direction of arrow A. The document may be fed from a face-up stack of documents in the document organizer 12, if desired. The inserted document lead edge trips a switch 51 at the nip of the input or upstream rollers 55. The document is then automatically fed in by the CVT 54, and it next actuates a second switch 53 in the downstream rollers 56 nip. The CVT 54 advances the documents downstream until it reaches a pause position, in which only the trailing edge of the document is in the CVT 54, held in the downstream rollers 56 nip. This is signaled and calculated from the release of switch 51 as the trail edge of the document passes that switch. At that document pause position the machine then stops, and waits for the insertion of a copy sheet. Note that the document was not copied in this step, unlike a normal large document copier. Thus, this initial step may be done with a much higher document feeding speed than is used for copying. Also note that in this position that the rest of the document is now in path A', at the rear of the machine 8, and none of it is obstructing the front of the machine.

Due to gravity, the document will hang downwardly in path A'. A document catch tray 180 has a guide baffle extension portion 182 positioned to engage and guide a large document fed downstream by CVT 54 into this tray 180.

The copy sheet is then unobstructedly inserted into the nip of the registration roll pair 150, 160 as shown by arrow B, and released by the operator. This also actuates associated switch 152. In response to this and the operator actuation of the controller display "start print" or "copy " button, the microprocessor controller 100 then restarts the document sheet CVT drive 54 in the reverse direction, again without copying, and at a much higher speed than the document copying speed. This briefly feeds the entire document out to the front of the machine again (reversing path A), but only temporarily, and only until the document lead edge is back in the upstream or input nip of rollers 55, in a position for start of scan. Then the document and copy sheet are both automatically driven in synchronism with one another, at the copying speed, with the document traveling into the machine in the direction of arrow A and the copy sheet traveling into the machine in the direction of arrow B.

This process may then be repeated for the number of copies required and/or set into the controller 100 by conventional operator display buttons. However, with this system, the document does not need to be initially reloaded for subsequent copies. The document remains held in at least one nip of the CVT 54 at all times until all the selected number of copies thereof are made.

After the selected number of copies are made of the document, the document is automatically ejected via path A' into tray 180, up to front stop fingers 184. This tray 180 need not be as long as the document. After the trail edge of the document is released by the rollers 56 nips, a trail end portion of the document may be allowed to fall and overhang the rear end of the tray 180 as shown by document path A".

Note that this document tray 180 is front accessible for operator front unloading. So are all the other trays of this copying machine. Also, all of the disclosed document and copy trays 12, 180, 170, 144 and 143 here are respectively superposed, overlying one another, and the copier processor 10, to provide a compact machine.

In the preferred copy dimensional correction system demonstrated herein, the copier control panel or operator console (see controller 100 in FIG. 1), in addition to the usual button or switch selections, such as "start", has special function keys for the present system. Preferably, the operator is forced before copying to first select one of three different copy media buttons: "Bond", "Vellum", or "Film". Each of these three copy media buttons, as in the prior Xerox Corporation "2510" large sheet copier, selects an appropriate fuser temperature level for that respective media.

However, here this copy media button selection also sets a corresponding nominal stepper motor pulse rate, and thereby a nominal document sheet feeding velocity, from programmable nonvolatile memory in the controller 100. (This general type of reprogrammable memory system per se for copiers is taught in more detail in, for example, Xerox Corporation U.S. Pat. No. 4,196,476).

The operator runs a first copy with this automatic nominal media button setting. Then the operator overlays that copy on the original document to compare the dimensional difference in the direction of copy travel (the direction of copy processing). If no adjustment is desired or required, no changes need be made before making further copies. If adjustment is desired or required for the copy image the dimensional difference can be measured, e.g., in millimeters with the ruler provided on the bottom of the scale adjust card shown in FIG. 3. The dimensional difference measured is the difference between the document and copy image sizes, not the sheet sizes. One common image border or edge of the respective document and copy images are overlaid, and then the distance by which the other, opposite, image border or edge of the copy image is shorter than, or extends beyond (+or −), the document image is measured. The operator the follows the directions shown printed on this FIG. 3 scale adjust card to find a correction number, and its polarity, from that measured difference. The operator presses a "Scale Adjust" key. The current adjust level (here a +10 to −10 number), is displayed on the operator console. The operator console also has "+" and "−" keys, which are enabled by the actuation of the "Scale Adjust" key. On each click or actuation of the "+" or "−" key one adjust level number is entered. The "+" or "−" key is pressed by a number of times equal to the correction number found from the scale adjust card. This is now a programmed "fine tuning" adjusting of the initial, nominal, stepper motor pulse rate for that media button. By a second actuation of the "Scale Adjust" key, this new setting is put into nonvolatile memory, to remain operative until it is changed again (by subsequent actuation of the "Scale Adjust" key). For example, if the originally displayed nominal correction number for that media button was +4, and the correction number was −5, the newly displayed correction number will be −1, and once the "Scale Adjust" key is pressed it will remain so until corrected again later.

The table below shows the operator selected copy size adjustment or correction number in the left column, the corresponding resultant change in document velocity (document feeder speed adjustment) for that selected number in the middle column, and the corresponding resultant percentage change in the image size on the copy sheet in the right column. Note that the "0" is a speed match, for zero copy sheet shrinkage or expansion. At the "0" position the document velocity is set at the same (here, 2.4 inches per second) velocity as the photoreceptor surface is being driven. The controller 100 sets the pulse rate to the document feeder stepper motor control accordingly and proportionately, to the closest available number. Preferably a gear ratio drive, such as a 4:1 ratio, is provided between the stepper motor and the drive shafts of the document feeder.

| Adjust Position | Document Velocity | % Size |
|---|---|---|
| −9 | 2.446 | 98.1 |
| −8 | 2.441 | 98.3 |
| −7 | 2.436 | 98.5 |
| −6 | 2.428 | 98.7 |
| −5 | 2.426 | 98.9 |
| −4 | 2.421 | 99.2 |
| −3 | 2.415 | 99.4 |
| −2 | 2.410 | 99.6 |
| −1 | 2.405 | 99.8 |
| +0 | 2.400 | 100.0 |
| +1 | 2.396 | 100.2 |
| +2 | 2.391 | 100.4 |
| +3 | 2.386 | 100.6 |
| +4 | 2.381 | 100.8 |
| +5 | 2.376 | 101.0 |
| +6 | 2.371 | 101.2 |
| +7 | 2.366 | 101.4 |
| +8 | 2.361 | 101.6 |
| +9 | 2.357 | 101.8 |

With the above described system, compensation and correction for large copy sheet shrinkage in the fuser, or other desired image magnification corrections or changes, can be made readily and simply, yet very accurately, even by a relatively unskilled copier operator.

As previously noted above, the system and apparatus herein has extended utility for deliberate image reduction or magnification. The correction control number entries described above, or other, larger, CVT velocity change entries, may be utilized to change the ratio of copy image to document image for a desired image reduction or magnification. For example, to leave copy margins, or fill the copy sheet.

For proper uniform or orthogonal image change, the above-noted dual pass system may be used, which does not require any special or expensive anamorphic lens, or any lens change. Image reduction or magnification is done in one axis at a time. An anamorphic copy is first formed from the moving original document in the first copying pass. That anamorphic copy is then used as an intermediate document in a second copying pass, but this intermediate document is rotated and fed into the document feeder at 90 degrees in the second pass relative to the first pass, but with the same document speed setting. That provides anamorphic reduction or enlargement of the image on the other axis, and thereby proper, uniform, image reduction or magnification on the final, second pass, copy.

The above cited prior art teaches copying processes in which a document is moved past an optical scanning slit at a controlled speed in a copying pass to form an image of the document on a copier imaging surface by slit scan exposure of the document while the document is moved past the optical scanning slit at a present speed differing from the speed of said imaging surface to provide image reduction or magnification on an anamorphic copy made from said imaging surface in the direction of movement. However, this extended utility dual-pass system provides a uniform, orthogonal, image reduction or magnification copy, utilizing a normal, non-anamorphic, lens, and without changing lens, by using a two copying pass image reduction or magnification, on one axis at a time, in which an anamorphic copy is first made from the original document in a first copying pass, and then said anamorphic copy is used as an intermediate document for a second copying pass, but for said second copying pass said anamorphic copy is initially rotated 90 degrees and then moved past said optical scanning slit oriented at 90 degrees in this second pass relative to said first pass, to provide anamorphic reduction of the image on that other axis, for proper, uniform, orthogonal, image reduction or magnification on the second pass copy.

While the embodiment disclosed herein is preferred, it will be appreciated from this teaching that various alternatives, modifications, variations or improvements therein may be made by those skilled in the art, which are intended to be encompassed by the following claims:

We claim:

1. A copying system for making large copies of large documents on a large document copier, in which a document is moved past an optical scanning slit by a large document feeder in a copying pass, to form, via a lens system, an image of the document on a copier imaging surface by slit scan exposure of the document while the document is moved past the optical scanning slit at a preset speed proportional to the speed of said imaging surface, and wherein the image of the document on the imaging surface is transfer copied onto a selected large sheet or web copy media to form a copy image thereon;

the improvement in controlling and adjusting the size of the copy image relative to the document image, including compensation for copy media dimensional changes due to said copying, by controlled adjustment of the magnification or reduction of the document image, without anamorphic or other lens changes, comprising the steps of:

making a test copy of the document onto the selected large copy media said large document copier;

measuring the dimensional change in the copy image on said selected large copy media, relative to said document image, in the direction of movement;

deriving a correction factor corresponding to said measured dimensional change;

entering said correction factor into a variable speed control for said large document feeder to reset the speed of said movement of the document past said optical scanning slit by an amount proportional to said correction factor, to provide a corresponding image reduction or magnification dimensional change of the copy image on the copy media in the direction of movement;

and making a subsequent copy on said large copy media with said document moving past said optical scanning slit at said reset speed.

2. The copying system of claim 1, wherein said deriving of a correction factor corresponding to said measured dimensional change comprises a simple calculation including the approximate overall length in the movement direction of the test copy media or the document, and wherein said correction factor is a simple number.

3. The copying system of claim 1, wherein said large document is retained throughout all said steps in said large document feeder without substantial slippage or skew, and wherein said document is further retained in said large document feeder until a selected further number of copies is made on the same type of large copy sheet or web media as the test copy, at the same said reset speed, before releasing that document from said large document feeder.

4. The copying system of claim 1, wherein the image of the document on the imaging surface which is copied onto a selected large copy sheet or web media is thermally fused onto said copy media in a heated fuser which changes the dimensions of said copy media, and wherein said system is operated to make a substantially exact size copy image of the document image which compensates for said dimensional changes of the copy media in said fuser.

5. The copying system of claim 1, wherein said correction factor is a number programmably stored in nonvolatile memory in said copier and used for making subsequent copies on the same type copy media with the same correction factor.

6. The copying system of claim 1, wherein plural said correction factors, for different respective copy media, are stored in said copier and used for making subsequent copies on the same type of copy media with the same correction factor.

7. The copying system of claim 1, wherein plural different nominal correction factors, for different types of copy media, are selectively stored in said copier, and wherein, prior to copying, a selection is made in accordance with the type of copy media of one of said plural said correction factors for that type of copy media, and said one selected nominal correction factor is used for making said test copy by setting the speed of said movement of the document past said optical scanning slit to a speed proportional to said selected nominal correction factor.

8. The copying system of claim 7, wherein subsequent copies on the same type of copy media are made with the same said selected nominal correction factor until a new correction factor is entered.

9. The copying system of claim 8, wherein said deriving of a correction factor corresponding to said measured dimensional change comprises a simple calculation including the approximate overall length in the movement direction of the test copy media or the document, and wherein said correction factor is a simple number derrived with a simple numerical table, and wherein the image of the document on the imaging surface which is copied onto a selected large copy sheet or web media is thermally fused onto said copy media in a heated fuser which changes the dimensions of said copy media, and wherein said system is operable to so derive and so enter a correction factor providing a substantially exact size copy image of the document image which compensates for said dimensional changes of the copy media in said fuser.

10. The copying system of claim 1 wherein said deriving of a correction factor corresponding to said measured dimensional change is done with a simple numerical table.

11. The copying system of claim 1, wherein an orthogonally uniform image reduction or magnification copy is made therewith by using a dual copying pass image reduction or magnification, on one axis at a time, in which an anamorphic reduction or magnification copy is first made from the original document in a first copying pass on one axis, and then said anamorphic copy is used as an intermediate document for a second copying pass, but for said second copying pass said anamorphic copy is initially rotated 90 degrees and then moved past said optical scanning slit oriented at 90 degrees in this second pass relative to said first pass, to provide anamorphic reduction of the image on that other axis, for proper, uniform, orthogonal, image reduction or magnification on the second pass copy.

12. In a large document copier, having a large document sheet feeder with document drive means for moving a large document at a preset sheet feeding velocity past a scanning slit in said copier, for copying the large document image onto a large copy sheet or web fed into said copier by a large copy sheet or web feeder, the improvement in controlling and adjusting the size of the copy image relative to the document image, including compensation for copy media dimensional changes due to said copying, by controlled adjustment of the magnification or reduction of the document image, without anamorphic or other lens changes, comprising:

electronically controllable variable speed document drive means for driving said large document sheet feeder and a document therein at a selectable variable speed;

control means for controlling the speed of said document drive means in response to an entered correction factor determined from the dimensional change in the copy image on a test copy of said selected large copy media relative to said document image in the direction of movement to reset the speed of said movement of the document past said optical scanning slit by an amount proportional to said correction factor, to provide a corresponding image reduction or magnification dimensional change of the copy image on the copy media in the direction of movement;

said copier being adapted to make a subsequent copy on said large copy media with said document moving past said optical scanning slit at said reset document movement speed by storing said correction factor in said control means.

13. The large document copier of claim 12, wherein plural different nominal correction factors, for different types of copy media, are selectively stored in said copier control means, and wherein a selection is provided of one of said plural said correction factors for the selected type of copy media, and said one selected nominal correction factor is used for making said test copy by setting the speed of said movement of the document past said optical scanning slit to a speed proportional to said selected nominal correction factor.

14. The large document copier of claim 13, wherein subsequent copies on the same type of copy media are made with the same said selected nominal correction factor until a new correction factor is entered into said control means.

15. The large document copier of claim 12, wherein said large document sheet feeder and said control means are adapted to retain a large document in said large document sheet feeder without substantial document slippage or skew until a selected number of copies is made from a document at said reset sheet feeding velocity before releasing that document from said large document feeder.

* * * * *